US005358257A

United States Patent [19]

Pardi

[11] Patent Number: 5,358,257

[45] Date of Patent: Oct. 25, 1994

[54] VOLLEYBALL GAME NET

[75] Inventor: Edward M. Pardi, Madison, Conn.

[73] Assignee: Jayfro Corporation, Waterford, Conn.

[21] Appl. No.: 119,415

[22] Filed: Sep. 10, 1993

[51] Int. Cl.[5] ..... A63B 6/00; A63B 67/00

[52] U.S. Cl. ..... 273/411; 273/298

[58] Field of Search ..... 273/411, 29 B, 29 BA, 273/29 BB, 29 BC

[56] References Cited

U.S. PATENT DOCUMENTS 4,247,099 1/1981 Pandak ..... 273/29 BA
4,253,671 3/1981 Pace ..... 273/411
4,415,163 11/1983 Schoenig ..... 273/411
4,444,397 4/1984 Kaburagi et al. ..... 273/411
4,717,157 1/1988 Smith ..... 273/411

*Primary Examiner*—William H. Grieb
*Attorney, Agent, or Firm*—Kane, Dalsimer, Sullivan, Kurucz, Levy, Eisele and Richard

[57] ABSTRACT

A volleyball game net includes a headband construction from a textile cloth having a high tensile strength and an elongation of less than about 0.00083 percent at a specified working tension and temperature. A textile cloth footband and marginal tapes complete the net periphery. The side edges are made rigid by means such as reinforcing rods within the marginal tapes.

12 Claims, 2 Drawing Sheets

VOLLEYBALL GAME NET

BACKGROUND OF THE INVENTION

1. Field of the Invention

The invention relates to apparatus for use in sports activity and more particularly to volleyball game nets.

2. Brief Description of Related Art

Athletic games such as volleyball are played using a game net. The rules of the game generally specify the structure and disposition of the game net.

Official competition volleyball is currently played according to rules established by the U.S. Volleyball Association (USVBA). According to the rules, the net is a meter wide and 32' long, with 4" square mesh construction. Rules require a 2" white band at the top of the net. A ¼" support cable generally runs through a fold of the band. Some support cables are fastened to referees' stands, some to standards, and others maybe fastened directly to a wall. The net must be stretched tightly on the support cable. While the support cable is generally under a heavy tension to eliminate any sag, the net hangs on the cable with minimal horizontal tension along the plane of the cable. Rules require that no more than ¼" sag of the net at center is allowed, so a strong tightening device is needed to eliminate sag in the supporting cable. The cable needs to have a high tensile breaking strength. Also, it is preferred that the volleyball net itself be highly tensioned in a horizontal plane at both top and bottom margins and also in a vertical direction to form a flat, rectangular, configuration. These requirements for tensioning have raised particular problems which the prior art artisans have addressed extensively. Representative of the descriptions given in the prior art are those found in the following U.S. Patents.

The U.S. Pat. No. 4,253,671 (Pace) describes a pole structure for supporting a volleyball net and includes a complex cable tension and net tension adjusting device. The tension adjusting device includes elastomeric yarns, ultimately anchored to the earth. The elastic functions to continually take-up slack and inhibit sag in the support cable and in the game net.

U.S. Pat. No. 4,415,163 (Schoenig) concerns a portable volleyball net suspension system which also includes resilient (elastomeric) components to maintain tension on the net which is carried on a taut cable. This system differs essentially from that described in U.S. Pat. No. 4,717,157 (Smith) wherein elastomeric stretch cords are used instead of a support cable as ties to secure the net to standards and thereby apply tension to the secured net.

The U.S. Pat. No. 4,444,397 (Kaburogi et al.) describes a volleyball net suspending system which includes telescoping pole standards to adjust the net height. Within the pole is a winch which is attached to and receives an end of the net suspending cable. Adjustment of the cable tension is affected by cranking the winch device to take up slack in the cable. No provision is made for applying tension on vertical or bottom margins of the net.

The prior art methods and means for suspending a volleyball net are only partially satisfactory. The use of elastomeric cords or components have limitations, being affected by temperature, humidity, exposure to sunlight, permanent deformation under stress and elastic life. More importantly, the prior art means and methods of applying tension to the net are not fail-safe and can fail to maintain a uniform, proper tension during periods of use. The presence of the support cable within a fold of the top band and upon which the net can ride is also a potential problem. It wears upon the top band of the net, reducing net life. It also must be handled apart from the net when it is taken down for storage, since it would snarl and damage the net if rolled up with the net.

The volleyball net of the present invention provides easy and fail-safe official net heights, with no excessive sag. The net of the invention obviates the need for a separate, independent support cable to suspend the net from and consequently eliminates cable kinking and reduces fraying of the top band by movement along the support cable. By eliminating a need for the support cable, the hazards associated with a wire cable strung across at relatively low heights and the cable twisting and tearing which can occur when rolling the net up or releasing top tension suddenly for storage or transport are also eliminated.

SUMMARY OF THE INVENTION

The invention comprises a volleyball game net, which comprises;

a net adapted by size and configuration to meet the requirements of play in a volleyball game, said net having a mesh fabric body with a peripheral margin defined by a top edge, a bottom edge, a first side edge and a second side edge, said side edges being spaced apart from each other and joining the top edge to the bottom edge;

a headband attached to the top edge and extending between the first and the second side edges, said headband being a textile cloth having a high tensile strength and an elongation of less than about 0.00083 percent at a specified working tension and temperature.

The net of the invention offers characteristics which are superior to prior art nets.

DETAILED DESCRIPTION OF THE PREFERRED EMBODIMENTS OF THE INVENTION

Those skilled in the art will gain an appreciation of the invention from the following description of the preferred embodiments, when read in conjunction with a viewing of the accompanying drawings of FIGS. 1–5, inclusive.

Figure 1:
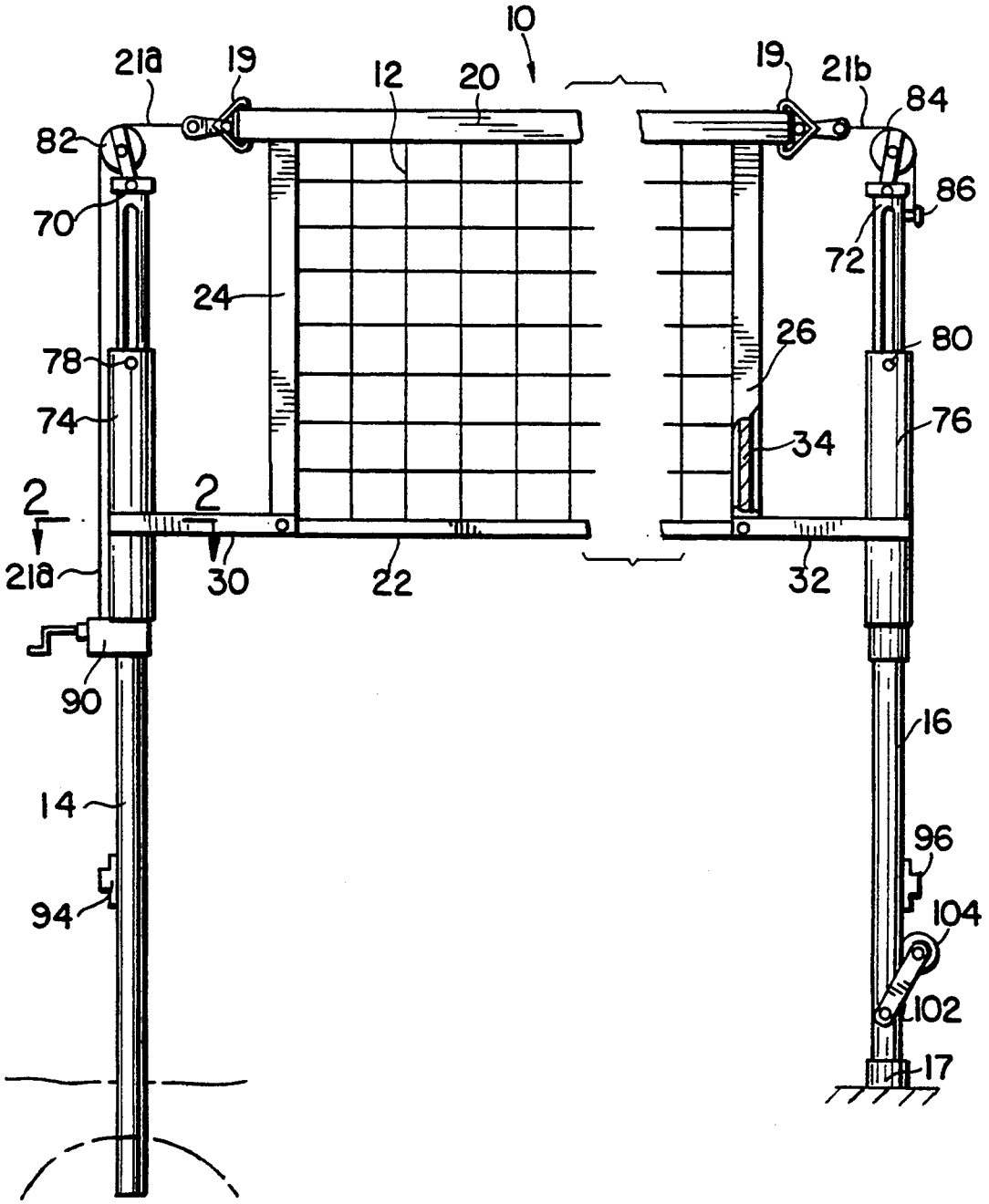
FIG. 1 is a fragmental view of a volleyball game net of the invention hung upon upright standards.

Referring now to FIG. 1, there is seen a fragmented view of a volleyball game net 10 of the invention. The net 10 is a USVBA regulation sized mesh 12 suspended between upright supports (posts) 14, 16. There is a headband 20 on the top edge of mesh 12. The headband 20 functions as the main element in a direct supporting system for the game net 10, substituting for a support cable transversing the game Court and previously used in the prior art game net assemblies (usually concealed or run through a folded over headband). For this purpose and change of function, the headband 20 is attached through a "D" ring 19 to a cable 21*a* or 21*b* on each side of headband 20 for connection to the support posts 14, 16. The headband 20 is advantageously a single, uninterrupted textile cloth. The headband 20 is advantageously a woven or knitted fabric having a plurality of substantially parallel, lengthwise textile yarns. The lengthwise yarns in the textile fabric or fabrics require a relatively high tensile strength, i.e.; a tensile breaking strength greater than about 500 lbs. per inch. The lengthwise yarns in the fabric of headband 20 advantageously have a minimum tensile strength of about 500 lbs. per inch, preferably at least about 750 lbs. per inch. Additionally, the lengthwise textile yarns will have low stretch (elongation) properties, for example on the order of at least about 1.0 percent (½ nominal breaking load) to about 15 to 20 percent, preferably about 4 to 6 percent at a specified working tension. It is advantageous if the lengthwise yarns exhibit uniformity in their shrink characteristics, i.e.; yarns of a high degree of shrinkability should not be mixed with yarns of a low degree of shrinkability to minimize buckling or cockling of the headband 20.

The lengthwise yarns may be selected from a wide variety of natural or synthetic yarns such as polyester, polyamide, polypropylene, polyamide, polyaramid and the like. Preferred yarns include yarns of linear terephthalic acid esters (Dacron ®) prepared in accordance with the description given in U.S. Pat. No. 2,465,319 and poly(p-phenylene terephthalamide (Kevlar ®), E. I. dupont, De Nemours. The yarns may be monofilament, spun or multifilament yarns or of mixed character. The cross-wise yarns employed in the fabric or cloth of headband 20 may be the same or different as the lengthwise yarns described above, but they need not possess the same properties in respect to tensile strength and elongation properties.

In one embodiment of the invention, headband 20 is an open weave fabric or webbing of monofilament lengthwise yarns. Any weave may be used, a plain or lend weave being stable and advantageous. Herringbone weaves are also advantageous as are triaxial woven fabrics. In these embodiments, the nature of the crosswise yarns is not critical and any conventional synthetic or natural fiber yarn can be used. Advantageously the denier of the yarns and the density of the weave is selected to provide a webbing weight of from about 4 to about 40 oz/square yard for optimum strength. Polyaramid yarns are particularly advantageous for use in such webs as the lengthwise and crosswise yarns for their exceptional weight/strength ratio.

In another embodiment, the textile yarns of headband 20 may be in a knit open mesh, which provides strength, stability, non-wicking properties, flex life and a webbing weight of from 4 to about 40 oz/square yard.

When the fabric of headband 20 is made of synthetic yarns, it is advantageously heat-set to fix the elongation properties. During heat-setting, the fabric is tensioned in the lengthwise direction (along the axis of the textile warp yarns) under from 0.5 to 20 lbs. per inch or more of fabric width. This treatment eliminates a large degree of stretching in the fabric. Heat-setting is carried out under temperatures dependent on the nature of the fibers and yarns used in the fabric. Those skilled in the art will appreciate the temperatures to be selected. For example, when all polyester components are found in the fabric, heat-setting may be carried out at temperatures within the range of from about 300° F. to 420° F. By selection of the type of yarns, weave of cloth and treatment of yarns and cloth, the textile cloth or webbing employed as the fabric of headband 20 will have an elongation of less than about 0.00083 percent at a specified working tension and temperature. This will translate into a suspended net 10 sag at working tensions and temperatures of less than ¼ inch at the net 10 center. although a wide variety of working tensions and temperatures may be prevalent, tension of from 100 to 800 lbs. on the headband 20 at temperatures of circa 50° to 100° F. are realistic. Representative of commercially available cloths or webbings suitable for fabrication of the headband 20 are X-ply aramids, Fiberplex ® aramid, polypropylene webbing (Pattern 7390; Elizabeth Webbing Co.), polyamide webbing (Pattern 7226 or 7321, Elizabeth Webbing Co.) and the like.

The cables 21*a, b* may be of any conventional, high tensile strength material such as woven wire, provided it has elongation properties similar to headband 20, i.e.; an elongation of less than about 0.00083 percent at a specified working tension and temperature. Preferably, the cables 21*a*, 21*b* are the same material as headband 20, i.e.; a webbing or rope of the same textile cloth described above for headband 20. In fact, the cables 21*a*, 21*b* may be extensions of the ends of headband 20 if so desired.

A footband 22 is on the lower edge of net 12 and marginal tape 24, 26 complete the dressing of the perimeter of mesh 12. There are no special requirements for the footband 22 or marginal tapes 24, 26. Conventionally used band material may be used. Ties 30, 32, help tension the mesh 12 by securing the bottom of the marginal tapes 24, 26 to the adjacent upright supports 14 or 16. All of the ties 30, 32 are non-elastomeric so that variations in tensioning of net 10 during use are minimal once the net is tensioned as described herein. The ties 30, 32 can be fabricated from the same materials as the footband 22. The ties 30, 32 may be secured to the upright supports at points slightly below the plane of the footband 22 so that when the net 10 is placed under tension it tends to pull downward upon and tension the net 10 in a vertical direction. The preferred net 10 includes within the marginal tapes 24, 26 a reinforcing rod 34 for stiffening the marginal tapes 24, 26. For example, ⅝" steel tubes or ¾" wood dowels may be securely sewn into and captured within the marginal tape 24, 26. Alternatively, the marginal tapes 24, 26 themselves can be of a rigid material such as rigid plastic. The rigidity of the side margins of the net 10 serve in "squaring" the net 10 under tension, i.e.; making tape 24 parallel to tape 26 and headband 20 parallel to footband 22, taking sag out of the net. This embodiment net of the invention wherein the marginal tapes 24, 26 are rigid or enclose rigid rods are advantageous in that the headband 20, footband 22 and any ties 30, 32 pull evenly on the marginal tapes 24, 26 and enclosed rods 34, thereby achieving flatness and rigidity of mesh 12 without the need for additional straps, ropes, cables and like structure between the headband 20 and the footband 22.

Figure 2:
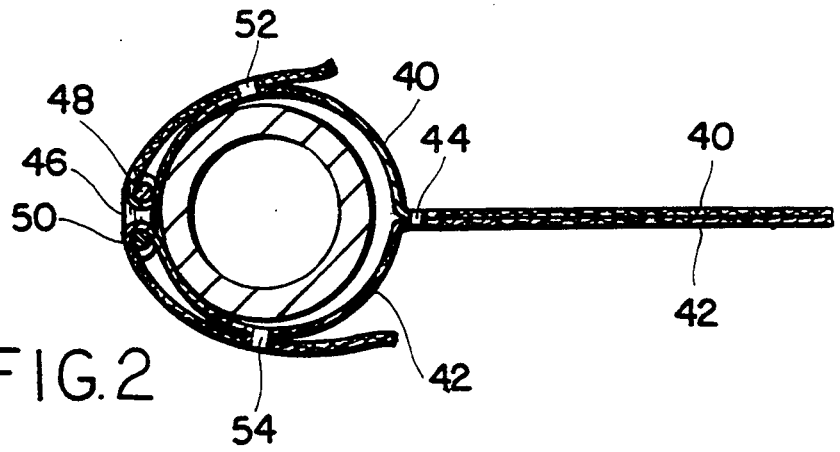
FIG. 2 is a view along lines 2—2 of FIG. 1, enlarged to show details of a tie means for suspending the net.

The ties 30, 32 and the extensions 21 of headband 20 may be adjustable in length to accommodate varying distances between the support posts 14, 16 and net 10 and to allow for adjusting horizontal tension on the net 10. Referring now to FIG. 2, there is seen a view along lines 2—2 of FIG. 1, greatly enlarged to show details of the tie 30. The tie 30 is a two-layered web (layers 40, 42) which separated from each other at point 44. The separated layers 40, 42 together encircle the support post 14 by reconnection through a coupler 46. The coupler 46 includes a roller 48 and a roller 50 over which the separate layers 40, 42 are threaded, respectively, to change the direction of the separate layers 40, 42. The layers 40, 42 after passing over the respective rollers 48, 50 fold upon themselves. Keepers 52, 54 hold the folded over portions of the respective layers 40, 42 together, securing the encirclement of support post 14 by the tie 30. The keepers 52, 54 may be, for example, belt buckles, removable rivets or any means of securing the two layers 40, 42 to the folded over portions thereof. Advantageously, a removable keeper 52, 54 means is used so that adjustments to tension of the footband 22 can be made.

Figure 3:
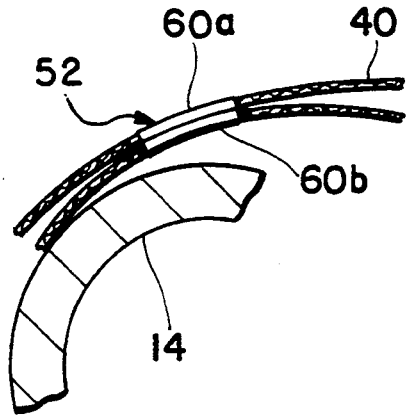
FIG. 3 is an enlarged view of FIG. 2.

In a preferred game net 10 of the invention, the keepers 52, 54 are fabric fasteners of the hook and loop type as shown in FIG. 3. FIG. 3 is an enlarged view of the keeper 52 shown in FIG. 2 and which may comprise two strips of fabric components. One strip (which may be strip 60*a* or 60*b* described hereinafter) may be referred to as the loop or the "pile component" and is fabricated from a pile fabric material. The pile material may be densely matted collection of strand loops of a synthetic resin fiber. The second component (which is the other of the strips 60*a* or 60*b*) is the hook component, which may be a twill fabric, having projecting fiber ends, hooked at the end. When the two components are brought together, the hook members of the hook component enter the pile and the hooks will thus become engaged in or will grip the loops of the pile and effect the firm coupling together of the components. Release of the cooperating interlocked elements of the components is effected by grasping the free end of one of the components and pulling outwardly on the same from the mating component. This will cause the hook members and the loops of the pile to disengage from interlock. The fasteners can be repeatedly opened and closed. The fabric fasteners are described further in the U.S. Pat. No. 2,717,437, incorporated herein by reference thereto and are commercially available under the tradename Velcro ®.

For the sake of brevity, the tie 30 has been described in detail, but the description can be applied also to the tie 32.

Figure 4:
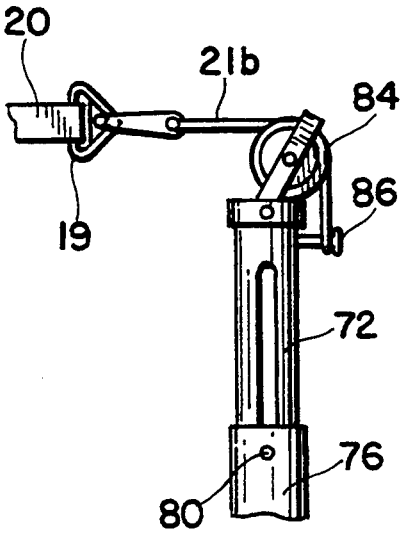
FIG. 4 is an enlarged view of the structure connecting the net of the invention shown in FIG. 1 to a support post.

However, in a preferred embodiment volleyball net assembly of the invention, the support posts 14, 16 are constructed for easy hanging and takedown of the net 10. As shown in FIG. 1 for purposes of illustration, the support post 14 is permanently installed in the ground, and post 16 is temporarily secured in a stanchion 17 which in turn is permanently installed in the ground. The post 16 is removable from the stanchion 17 for storage. In addition, both of the support posts 14, 16 can be partially disassembled by removing the movable (sliding) extensions 70, 72 from the containing sleeves 74, 76. The extensions 70, 72 may be slidingly raised or lowered within respective sleeves 74, 76 to adjust the height of net 10 above the ground surface. Pins 78,80 may be used to secure extensions 70,72 at a selected height, if desired. A pulley 82 or 84 is mounted on the top of each extension 70, 72 to carry the cables 21*a*, 21*b* (or an equivalent strap) downward in a vertical direction. On one side, the cable 21*b* is secured to post 16 extension 72 by a post projection 86. On the other side, pulley 82 carries the cable 21*a* down to a worm drive winch 90 mounted on post 14. The winch is used to apply tension to the headband 20 between cables 21*a*, 21*b*. Further details of the construction of the pulley 82, 84/cable 21*a*, 21*b* system is shown in FIG. 4, an enlarged view of the structure shown in FIG. 1. The arrangement of pulley 82/cable 21*a* is similar.

Figure 5:
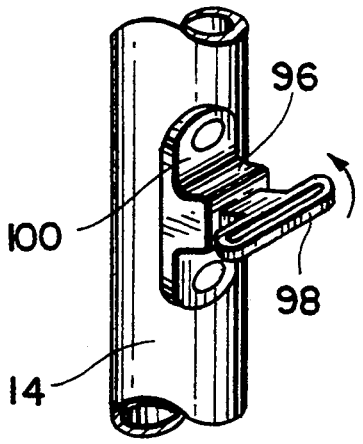
FIG. 5 is an enlarged view of a step device mounted on the support posts shown in FIG. 1.

In further embodiments of the volleyball net assembly of the invention, steps 94 and 96 can be mounted on the respective support posts 14, 16. FIG. 5 is an enlarged view of a portion of the mounted, folding step 94 as shown on support post 14. The tread 98 component folds upward in the direction of the arrow to position adjacent to and against the riser 100 when not in use. The steps 94, 96 are useful to climb upon and reach the mechanisum of pulleys 82, 84 when necessary for servicing, maintenance, assembly or disassembly of the net 10.

Where the support posts are readily removable when not in use (as shown with support post 16 in FIG. 1) it is also advantageous to mount on the post near the bottom end a pivotable arm 102 carrying a wheel 104 as a means of facilitating movement of the net assembly of the invention to and from a storage site.

It will be appreciated from the above description that the net 12 of FIG. 1 tensions in vertical and horizontal directions without the use of elastic tensioning devices, and is a sag-proofing means of doing so.

Those skilled in the art will appreciate that many modifications may be made to the above-described preferred embodiments of the invention without departing from the spirit and the scope of the invention. For example, the amount of hardware required for suspending the net 10 may be reduced. One can attach the cables 21*a*, 21*b* to any available tensioning devices such as a winch, ratchet buckle, or the like, for applying tension to the headband 20 of net 10. The net is very light in weight and can weigh as little as 6 to 7 ozs. in total weight and have a thickness of circa 0.05 inches. It is readily folded or rolled up and carried for storage or use elsewhere.

What is claimed is:

1. A volleyball game net which comprises:

a net adapted by size and configuration to meet the requirements of play in a volleyball game, said net having a mesh fabric body with a peripheral margin defined by a top edge, a bottom edge, a first side edge and a second side edge, said side edges being spaced apart from each other and joining the top edge to the bottom edge;

a headband attached to the top edge and extending between the first and the second side edges, said headband being a textile cloth having a high tensile strength and an elongation of less than about 0.00083 percent at a specified working tension and temperature;

a textile cloth footband attached to the bottom edge;

textile cloth marginal tapes attache dot the first and second side edges; and a first reinforcing rod within the marginal tape of the first side edge and a second reinforcing rod within the marginal tape of the second side edge.

2. A volleyball game net which comprises: a net adapted by size and configuration to meet the requirements of play in a volleyball game, said net having a mesh fabric body with a peripheral margin defined by a top edge, a bottom edge, a first side edge and a second side edge, said side edges being spaced apart from each other and joining the top edge to the bottom edge;

a headband attached to the top edge and extending between the first and the second side edges, said headband being a textile cloth having a high tensile strength and an elongation of less than about 0.00083 percent at a specified working tension and temperature;

a textile cloth footband attached to the bottom edge;

textile cloth marginal tapes attached to the first and second side edges; and wherein the marginal tapes are rigid.

3. The net of claim 2 wherein the marginal tapes are secured at the bottom by tie means.

4. The net of claim 3 wherein the tie means includes a hook and loop fabric fastener.

5. A volleyball net which comprises: a net adapted by size and configuration to meet the requirements of play in a volleyball game, said net having a mesh fabric body with a peripheral margin defined by a top edge, a bottom edge, a first side edge and a second side edge, said side edges being spaced apart from each other and joining the top edge to the bottom edge;

a headband attached to the top edge and extending between the first and the second side edges, said headband being a textile cloth having a high tensile strength and an elongation of less than about 0.00083 percent at a specified working tension and temperature;

non-elastomeric tie means on the headband at the first and second edges for tensioning and supporting the headband;

said tie means comprising a textile cloth having a high tensile strength and an elongation of less than about 0.00083 percent at a specified working tension and temperature.

6. A volleyball net assembly which comprises:

a net adapted by size and configuration to meet the requirements of play in a volleyball game, said net having a mesh fabric body with a peripheral margin defined by a top edge, a bottom edge, a first side edge and a second side edge, said side edges being spaced apart from each other and joining the top edge to the bottom edge;

a headband attached to the top edge and extending between the first and the second side edges, said headband being a textile cloth having a high tensile strength and an elongation of less than about 0.00083 percent at a specified working tension and temperature;

non-elastomeric tie means on the headband at the first and second edges for tensioning and supporting the headband;

a second tie means which comprises extensions of the footband attached to the bottom edge and includes fastener means of the hook and loop type of fabric fastener;

wherein the first and second side edges include rigidifying means.

7. The assembly of claim 6 wherein the rigidifying means comprises textile tapes enclosing rigid reinforcing rods.

8. A volleyball net assembly which comprises:

(a) a net adapted by size and configuration to meet the requirements of play in a volleyball game, said net having a mesh fabric body with a peripheral margin defined by a top edge, a bottom edge, a first side edge and a second side edge, said side edges being spaced apart from each other and joining the top edge to the bottom edge;

(b) a headband attached to the length of the top edge and extending along a straight line substantially parallel to the top edge of the net, said headband having a first end at a point on the line adjacent the first side edge and a second end at a point on the line adjacent the second side edge whereby the headband has a length exceeding the length of the top edge of the net, said headband being a textile cloth having a high tensile strength and an elongation of less than about 0.00083 percent at a specified working tension and temperature;

said line being above and substantially parallel to the ground surface when the net assembly is in use;

(c) first means for supporting the headband and the attached net at the first point on the line, above the ground surface;

(d) second means for supporting the headband and the attached net at the second point on the line, above the ground surface;

(e) non-elastic, first means for connecting the headband to the first means for supporting, including a cable having high tensile strength and an elongation of less than about 0.00083 percent at the specified working tension and temperature;

(f) non-elastic, second means for connecting the headband to the second means for supporting, including a cable having high tensile strength and an elongation of less than about 0.00083 percent at the working tension and temperature;

said cable of the first non-elastic means being independent of and free from contact with the cable of the second non-elastic means; and (g) means for maintaining a tension of from 100 to 800 lbs. on the headband;

whereby the supported and tensioned headband does not deviate from the line by more than about 0.25 inches at the working temperatures.

9. The assembly of claim 8 wherein the first and second means for supporting the headband and the attached net comprises posts.

10. The assembly of claim 9 wherein the posts are adjustable in height.

11. The assembly of claim 9 wherein the non-elastic first and second means comprise metal wire cables.

12. The assembly of claim 11 wherein the means for tensioning the headband comprises a winch attached to one of the cables.

* * * * *